US012716666B2

(12) United States Patent
Rawson-Harris

(10) Patent No.: US 12,716,666 B2
(45) Date of Patent: Aug. 25, 2026

(54) FIREARM

(71) Applicant: Douglas Rawson-Harris, Mona Vale (AU)

(72) Inventor: Douglas Rawson-Harris, Mona Vale (AU)

(73) Assignee: Douglas Rawson-Harris, Mona Vale (AU)

( * ) Notice: Subject to any disclaimer, the term of this patent is extended or adjusted under 35 U.S.C. 154(b) by 0 days.

(21) Appl. No.: 18/693,567

(22) PCT Filed: Sep. 20, 2022

(86) PCT No.: PCT/AU2022/051131

§ 371 (c)(1),
(2) Date: Mar. 20, 2024

(87) PCT Pub. No.: WO2023/039644

PCT Pub. Date: Mar. 23, 2023

(65) Prior Publication Data

US 2024/0426564 A1 Dec. 26, 2024

(30) Foreign Application Priority Data

Sep. 20, 2021 (AU) ..... 2021903016

(51) Int. Cl.
*F41A 3/62* (2006.01)
*F41A 3/38* (2006.01)
(Continued)

(52) U.S. Cl.
CPC ..... *F41A 3/62* (2013.01); *F41A 3/38* (2013.01); *F41A 3/44* (2013.01); *F41A 3/78* (2013.01)

(58) Field of Classification Search
CPC ..... F41A 3/36; F41A 3/38; F41A 3/40; F41A 3/44; F41A 3/46
(Continued)

(56) References Cited

U.S. PATENT DOCUMENTS 1,550,759 A 8/1925 Swebilius
3,793,922 A 2/1974 Frielich et al.
(Continued)

FOREIGN PATENT DOCUMENTS

DE 19910127 A1 12/1999
DE 19843591 A1 4/2000
WO 9637747 A1 11/1996

OTHER PUBLICATIONS

International Preliminary Report on Patentability issued in International Application No. PCT/AU2022/051131, mailed Mar. 26, 2024, 7 pages.

(Continued)

*Primary Examiner* — Bret Hayes
(74) *Attorney, Agent, or Firm* — KDW Firm PLLC

(57) ABSTRACT

The present invention relates to a firearm, which includes a receiver and a barrel mountable to the receiver. A slide is mountable to the receiver so as to be movable between an open position and a closed position. A locking element is operatively associated with the barrel. The locking element is displaceable between an inactive position and an active position whereby, when the locking element is in the active position, the locking element engages the slide such that movement of the slide towards the open position is inhibited.

19 Claims, 8 Drawing Sheets

(51) Int. Cl.
*F41A 3/44* (2006.01)
*F41A 3/78* (2006.01)

(58) Field of Classification Search
USPC ..... 89/180, 181, 184, 185, 187.01, 188, 189
See application file for complete search history.

(56) References Cited

U.S. PATENT DOCUMENTS

| | | | | |
|---|---|---|---|---|
| 4,398,448 | A * | 8/1983 | LaFever | F41A 3/26 89/185 |
| 5,404,790 | A | 4/1995 | Averbukh | |
| 10,816,287 | B1 * | 10/2020 | Russo | F41A 3/46 |
| 2005/0235817 | A1 * | 10/2005 | Murello | F41A 3/46 89/33.01 |
| 2014/0352187 | A1 | 12/2014 | Bubits | |
| 2015/0276334 | A1 | 10/2015 | Pflaumer | |

OTHER PUBLICATIONS

Military Wiki Fandom, "Heckler & Koch P7," [online] military-history.fandom.com, 13 pages, May 25, 2022, retrieved from Internet URL: https://military-history.fandom.com/wiki/Heckler_%26_Ko . . . >.

Extended European Search Report in European Application No. 22868478.3 dated Oct. 1, 2025, 12 pages.

* cited by examiner

FIREARM

This application is a U.S. national stage application filed under 35 U.S.C. § 371 of pending International Patent Application No. PCT/AU2022/051131 filed 20 Sep. 2022, which claims priority to Australia Patent Application No. 2021903016 filed 20 Sep. 2021, the entireties of which are hereby incorporated by reference herein.

TECHNICAL FIELD

The present invention relates to a firearm, particularly to an action for a firearm.

The invention has been developed primarily for use with a repeating or semi-automatic handgun or pistol and will be described predominately in this context. It should be appreciated, however, that the invention is not limited to this particular field of use, and can also be used in connection with a wide range of firearms and guns including, but not limited to, automatic rifles, sub-machine guns and larger field guns.

BACKGROUND TO THE INVENTION

The following discussion of the prior art is intended to place the invention in an appropriate technical context and enable its advantages to be more fully appreciated. However, any references to prior art throughout this specification should not be construed as an express or implied admission that such art is widely known or is common general knowledge in the relevant field.

A wide variety of firearms and firearm actions have been developed over the years. Existing arrangements often incorporate a high number of moving parts that must move in a particular sequence and accord to precise timing requirements. Furthermore, these actions must function smoothly and precisely whilst being subject to extremely highly working pressures when the firearm is discharged. As such, firearm actions are prone to jamming or failure over time. In addition, many existing firearm actions are highly complex in design and thus difficult and expensive to manufacture to the necessary level of precision required to promote efficient, repeatable and accurate use of the firearm.

It is an object of the present invention to overcome or ameliorate one or more disadvantages of the prior art, or at least to provide a useful alternative.

SUMMARY OF THE INVENTION

According to one aspect of the present invention there is provided a firearm, including:

- a receiver;
- a barrel mountable to the receiver;
- a slide mountable to the receiver, the slide being movable between an open position and a closed position; and
- a locking element operatively associated with the barrel, the locking element being displaceable between an inactive position and an active position such that, when the locking element is in the active position, the locking element engages the slide such that movement of the slide towards the open position is inhibited.

Preferably, the firearm is a repeating firearm. In some embodiments, the firearm is a semi-automatic firearm. In some embodiments, the firearm is an automatic firearm. In some embodiments, the firearm is selected from the group including: guns, handguns, pistols, rifles, sub-machine guns and field guns.

In some embodiments, the firearm is configured to selectively discharge or fire discrete (individual) rounds of ammunition in a sequential manner. Preferably, each discrete (individual) round of ammunition is in the form of a cartridge. Each cartridge preferably includes a case, a projectile (e.g. bullet), a propellant (e.g. gunpowder or other explodable particulate material or chemical substance) and a primer. Preferably, the external diameter of the case is greater than the external diameter of the projectile (bullet). Preferably, the internal diameter of the case is greater than the external diameter of the projectile (bullet), whereby the projectile can be at least partially received within the open end of the case.

In some embodiments, each round of ammunition is a rimfire cartridge. In some embodiments, each round of ammunition is a centrefire cartridge.

In some embodiments, the receiver is elongate and includes a proximal (cocking or loading) end and a distal (discharge) end. In some embodiments, the receiver has a hollow interior. In some embodiments, a (hand) grip is arranged at or adjacent to the proximal end of the receiver. In some embodiments, the grip extends transversely (e.g. downwardly) from the receiver. In some embodiments, the grip is substantially aligned with the longitudinal axis of the receiver. In some embodiments, the grip is integrally formed with the receiver. In some embodiments, the grip is releasably attachable to the receiver.

In some embodiments, the barrel is releasably mountable to the receiver. In some embodiments, the barrel is mountable within the hollow interior of the receiver. In some embodiments, the barrel is mountable to the receiver such that the barrel is housed entirely within the receiver. In some embodiments, the barrel is mountable to the receiver such that the barrel is partially housed within the receiver. In some embodiments, a distal end of the barrel projects outwardly from the distal end of the receiver when the barrel is mounted to the receiver, whereby the distal end or tip of the barrel is spaced from the distal end of the receiver.

Preferably, the barrel is elongate and has a through passageway or bore extending along the length of the barrel, wherein the barrel has a rear opening formed at the proximal end of the barrel for receiving a cartridge and a forward opening formed at the distal end of the barrel to enable the projectile of the cartridge to be discharged from or otherwise exit the barrel.

Preferably, the longitudinal axis of the barrel is aligned with the longitudinal axis of the receiver when the barrel is mounted to the receiver. In some embodiments, the cross-sectional profile of a bore or passageway of the barrel varies along the length of the barrel. In some embodiments, the cross-sectional profile of the bore or passageway of the barrel varies along the length of the barrel in a constant or regular manner, or an irregular manner. In some embodiments, the cross-sectional profile of the bore or passageway of the barrel varies along the length of the barrel in a stepwise manner. For example, a first section of the bore may have a first diameter and a second section of the bore may have a second diameter, wherein the first and second diameters are different. In some embodiments, the cross-sectional profile of the barrel is constant along the length of the barrel. Preferably, the inner cross-sectional profile of the bore of the barrel (or each section of the bore of the barrel) is circular in shape.

In some embodiments, the barrel includes a stop for limiting the extent to which the cartridge can be received into (or can travel along) the barrel. In some embodiments, the stop is arranged within the hollow interior of the barrel.

Preferably, the stop is arranged at a predetermined distance from the rear opening of the barrel. In some embodiments, the stop includes one or more projections extending inwardly from an interior wall of the barrel. In some embodiments, the stop is defined by a change to the configuration of the profile of the interior wall of the barrel.

In some embodiments, the stop is arranged at a predetermined distance from the rear opening of the barrel. Preferably, the stop is spaced from the rear opening of the barrel by a distance equal to or greater than the length of the case of the cartridge.

In some embodiments, the barrel has a first portion having a first configuration and a second portion having a second configuration, wherein the stop is defined by the intersection between the first portion and second portion of the barrel. In some embodiments, the first portion of the barrel has a first diameter, and the second portion of the barrel has a second diameter, wherein the first diameter is greater than the second diameter. Preferably, the first diameter is equal to or less than the external diameter of the case of the cartridge, and greater than the external diameter of the projectile (bullet) of the cartridge, whereby the projectile can freely pass from the first portion of the barrel to the second portion of the barrel whilst the case is prohibited from passing into the second portion of the barrel. In such embodiments, the first portion of the barrel is arranged so as to be closer to the proximal or cocking end relative to the second portion of the barrel, and the second portion of the barrel is arranged so as to be closer to the distal or discharge end relative to the first portion of the barrel.

In some embodiments, the barrel includes a receiving formation for receiving the locking element. Preferably, the receiving formation extends from the bore of the barrel to an external surface of the barrel, wherein the receiving formation is in fluid communication with the bore of the barrel. In some embodiments, the receiving formation is formed in, and preferably through, an operatively upper surface of the barrel. In some embodiments, the receiving formation is a through hole or passageway extending from the inner surface of the bore of the barrel to the external surface of the barrel. Preferably, the receiving formation is formed or arranged so as to extend in a direction which is generally transverse, orthogonal or otherwise perpendicular to the longitudinal axis of the barrel. In some embodiments, a longitudinal axis of the receiving formation in the barrel extends transversely or orthogonally to the longitudinal axis of the barrel. In some embodiments, the receiving formation has a first opening at, in or adjacent, or otherwise associated with the inner surface of the bore of the barrel, and a second opening at, in or adjacent, or otherwise associated with the external surface of the barrel. In some embodiments, the receiving formation has a constant cross-sectional profile. In some embodiments, the cross-sectional profile of the receiving formation varies along the length (or height) of the receiving formation. In some embodiments, the open area of the first opening of the receiving formation may be the same as the open area of the second opening of the receiving formation. In some embodiments, the open area of the first opening of the receiving formation may be different compared to the open area of the second opening of the receiving formation. In some embodiments, the open area of the first opening of the receiving formation may be less than the open area of the second opening of the receiving formation. In some embodiments, the open area of the first opening of the receiving formation may be greater than the open area of the second opening of the receiving formation.

In some embodiments, the shape or profile of the first opening of the receiving formation may be the same as the shape or profile of the second opening of the receiving formation. In some embodiments, the shape or profile of the first opening of the receiving formation may be a different compared to the shape or profile of the second opening of the receiving formation.

In some embodiments, the shape or profile of the first opening of the receiving formation may be regular. In some embodiments, the shape or profile of the first opening of the receiving formation may be irregular. In some embodiments, the shape or profile of the first opening of the receiving formation may be circular, oval, square, rectangular or other suitable polygonal shape.

In some embodiments, the shape or profile of the second opening of the receiving formation may be regular. In some embodiments, the shape or profile of the second opening of the receiving formation may be irregular. In some embodiments, the shape or profile of the second opening of the receiving formation may be circular, oval, square, rectangular or other suitable polygonal shape.

In some embodiments, the receiving formation formed in the barrel is generally complementary in profile to the locking element, preferably complementary to a profile of at least a portion of an external (surface) profile of the locking element. Preferably, the locking element is snugly or close-fittingly received within the receiving formation, yet freely movable between the inactive and active positions. In some embodiments, the receiving formation is configured such that the extent to which the locking element can be received in the receiving formation is limited. Preferably, the locking element is mounted or arranged so as to be movable, via back-and-forth motion (e.g. reciprocating linear motion) between the inactive and active positions, in a direction which is generally transverse, orthogonal or otherwise perpendicular to the longitudinal axis of the barrel. In some embodiments, a longitudinal axis of the locking element extends transversely or orthogonally to the longitudinal axis of the barrel.

In some embodiments, the receiving formation has a stepped profile in side view, preferably including a smaller lower section and a larger upper section (e.g. the lower section has a smaller diameter compared to the diameter of the upper section). In some embodiments, the receiving formation may have a generally T-shaped profile when viewed from the side. In some embodiments, the locking element may have a generally T-shaped profile when viewed from the side.

In some embodiments, the locking element is formed as a one-piece unit. In some embodiments, the locking element comprises two or more pieces or elements, the two or more pieces or elements being interconnected so as to move in a predetermined manner when the locking element moves between the inactive and active positions.

In some embodiments, the locking element is freely seated, placed, or otherwise positioned in the receiving formation formed in the barrel. In some embodiments, the locking element is anchored at least one point, yet displaceable between the inactive and active positions. In some embodiments, the locking element is pivotally mounted within the receiving formation formed in the barrel such that the locking element can pivot between the inactive and active positions. In some embodiments, at least one piece or element of the locking element is pivotally mounted within the receiving formation formed in the barrel. In some embodiments, the locking elements acts as a piston.

In some embodiments, the locking element has a lower or activation surface and an upper or engaging surface. In some embodiments, the locking element is configured such that, when the locking element is received in the receiving formation, the lower surface of the locking element is substantially flush with the (internal) surface of the bore of the barrel. In some embodiments, the locking element is configured such that, when the locking element is received in the receiving formation, the upper surface of the locking element is substantially flush with the external or outer surface of the barrel.

In some embodiments, the locking element is configured to move between the inactive position and the active position in response to a change in pressure within (the bore of) the barrel. In some embodiments, the locking element is configured to move from the inactive position to the active position in response to an increase in pressure within (the bore of) the barrel. In some embodiments, the locking element is configured to move from the active position to the inactive position in response to a decrease in pressure within (the bore of) the barrel. In some embodiments, the inactive position is an operatively lower position of the locking element. In some embodiments, the active position is an operatively upper or raised position of the locking element.

In some embodiments, the receiving formation formed in the barrel (and thus the locking element) is positioned closer to the proximal end than the distal end of the barrel. Preferably, the receiving formation formed in the barrel is configured such that the locking element is aligned with the projectile of the cartridge when the cartridge is positioned in the barrel (e.g. the first portion or firing chamber of the barrel). The receiving formation is preferably configured such that the lower or activation surface of the locking element (e.g. piston) is aligned with the projectile of the cartridge when the cartridge is loaded into the barrel. Preferably, the receiving formation formed in the barrel is configured such that the locking element is positioned downstream of the stop, or the first portion of the bore of the barrel. Preferably, the receiving formation formed in the barrel is configured such that the locking element is positioned downstream of the stop, or the first portion of the bore of the barrel, by a predetermined distance.

In some embodiments, the locking element is integrally formed as a (solid) one-piece element. In some embodiments, the locking element is formed from two or more members, wherein the two or members may be fixedly connected together or otherwise interconnected in a predetermined manner.

Preferably, the locking element is laterally constrained within the passageway formed by the receiving formation that is formed in the barrel. In some embodiments, the locking element (e.g. piston) is laterally constrained, whereby the locking element moves along a generally vertical axis (i.e. transverse or orthogonal to the longitudinal axis of the barrel) when the locking element moves from the inactive position to the active positions, and vice versa.

Preferably, when the locking element is arranged within the receiving formation, the lower or activation surface of the locking element is unobstructed or otherwise exposed to the bore of the barrel, thereby to enable a change in pressure within the bore of the barrel to be registered by the locking element and thus cause the locking element to move between the active and inactive positions in response to a change in pressure within the bore of the barrel, in use.

In some embodiments, the locking element directly engages the slide when the locking element is in the active position. In some embodiments, the locking element may indirectly engage the slide when the locking element is in the active position.

In some embodiments, when the locking element is in the active position, the locking element engages the slide in secure mating face-to-face contact, thereby to mechanically and/or frictionally hold or lock the slide in the closed position. Preferably, the action of the locking element or piston on the slide causes a corresponding (upward) movement of the slide, whereby the slide engages (the internal surface of) the receiver in secure mating face-to-face contact which further facilitates the mechanical and/or frictional locking of the slide in the closed position. That is, in some embodiments, movement of the locking element from the inactive position to the active position causes a corresponding upward movement of the slide, whereby the slide engages the receiver in secure mating face-to-face contact and thereby to facilitate frictional locking of the slide in the closed position.

In some embodiments, the locking element has a constant cross-sectional profile when viewed from above. In some embodiments, the cross-sectional profile of the locking element is circular, square, rectangular or other polygonal shape.

In some embodiments, the cross-sectional profile of the locking element varies. In some embodiments, the locking element has a first portion (e.g. an operatively lower portion) having a first cross-sectional profile, and a second portion (e.g. an operatively upper portion) having a second cross-sectional profile. In some embodiments, the area of the first cross-sectional profile may be substantially the same as the area of the second cross-sectional profile. In some embodiments, the area of the first cross-sectional profile may be greater than the area of the second cross-sectional profile. In some embodiments, the area of the first cross-sectional profile may be less than the area of the second cross-sectional profile.

In some embodiments, the cross-sectional area of the lower or activation surface of the locking element is less than the cross-sectional area of the upper or engaging surface of the locking element. In some embodiments, the cross-sectional area of the lower or activation surface of the locking element is greater than the cross-sectional area of the upper or engaging surface of the locking element. In some embodiments, the cross-sectional area of the lower or activation surface of the locking element is substantially the same as the cross-sectional area of the upper or engaging surface of the locking element.

In some embodiments, the upper or engaging surface of the locking element is a planar or flat surface. In some embodiments, the upper or engaging surface may include a chamfered or bevelled leading edge; for example, a 45 degree chamfer or bevel. Preferably, the size of the chamfer or bevel is within the range of 0.25 mm to 2.5 mm, more preferably 0.50 mm to 2.00 mm, and more preferably still 0.75 mm to 1.50 mm. The provision of such a bevel or chamber on the (upper) leading edge of the locking element (i.e. the slide facing edge of the locking element) advantageously facilitates smooth repeating reciprocal motion between the inactive and active positions of the locking element, thereby assisting in reducing undesirable jamming, catching or otherwise misalignment of the locking element when extreme forces are applied to the locking element, in use. In some embodiments, the upper or engaging surface of the locking element is configured to have one or more engaging elements to facilitate engagement with the slide. In some embodiments, the upper or engaging surface of the locking element is provided with one or more friction enhancing elements. In some embodiments, the engaging elements and/or friction enhancing elements may be formed directly in the upper or engaging surface of the locking element. In some embodiments, the engaging elements and/or friction enhancing elements may be separate elements applied, attached, adhered or otherwise fixed to the upper or engaging surface of the locking element.

In some embodiments, the locking element, preferably the upper or engaging surface of the locking element, engages an operatively lower surface of the slide. In some embodiments, the locking element, preferably the upper or engaging surface of the locking element, directly engages an operatively lower surface of the slide.

In some embodiments, the slide has an engagable surface or region against which the upper or engaging surface of the locking element bears against when in the active position. Preferably, the engagable surface formed in the slide has a complementary profile to that of the locking element, preferably to the upper or engaging surface of the locking element. Preferably, the engagable surface is formed in the operatively lower surface of the slide.

In some embodiments, the upper or engaging surface of the locking element has a curved profile. Preferably, the upper or engaging surface of the locking element is convexly curved.

In some embodiments, the engagable surface formed in the slide has a curved profile. Preferably, the engagable surface formed in the slide is inwardly or concavely curved.

Preferably, the engagable surface formed in the slide extends inwardly (i.e. away from the operatively lower surface of the slide) such that the upper or engaging surface of the slide is at least partially received in the engagable region when the locking element is in the active position.

In some embodiments, a bolt is attached to the slide such that movement of the slide causes a corresponding movement of the bolt, or vice versa. That is, the slide and bolt preferably move in unison. Preferably, the bolt is attached to an operatively rear end of the slide, whereby the bolt effectively closes the rear opening or breech of the barrel when the slide is in the closed position. In some embodiments, the slide has a bolt opening (e.g. slot) formed in an operatively upper surface of the slide and towards the rear end of the slide, and the bolt has a protrusion (e.g. flange or spigot) of complementary configuration or profile to the bolt opening such that the protrusion can be close-fittingly received (e.g. interference fit) in the bolt opening, thereby to securely attach the bolt to the slide.

In some embodiments, the bolt engages the rear end of the barrel in mating face-to-face contact when the slide is in the closed position.

In some embodiments, the bolt houses a firing pin. Preferably, the firing pin is slidably mounted to the bolt such that the firing pin is movable between a first (loaded) position and a second (firing) position. Preferably, the firing pin is biased towards the second (firing) position. A biasing means such as, for an example a spring (e.g. coil spring), is arranged within the bolt for biasing the firing pin towards the second (firing) position. Preferably, a sear is operatively associated with the firing pin, the sear being movable between a first position in which the sear engages the firing pin to hold the firing pin in the first (loaded) position against the action of the biasing means, and a second position in which firing pin is free to travel towards the second (firing) position under the action of the biasing means. That is, the sear preferably does not act on or otherwise interfere with the firing pin when the sear is in its second position.

In some embodiments, a buffer is arranged within the receiver, the buffer being configured to dampen the force associated with movement of the slide and firing pin towards the open position. In some embodiments, the buffer includes a force absorbing element or mechanism. In some embodiments, the force absorbing element or mechanism includes springs, washers or a combination thereof.

In some embodiments, a cocking slide is attached to the slide to facilitate cocking of the firearm, in use. Preferably, the cocking slide is slidably mounted the receiver. The cocking slide is preferably mounted externally on the receiver.

In some embodiments, the cocking slide is attached to the slide such that movement of the slide causes a corresponding movement of the cocking slide, or vice versa. That is, the slide and cocking slide preferably move in unison. Preferably, an operatively front end of the cocking slide is attached to an operatively rear end of the slide. In some embodiments, the cocking slide has a slide opening (e.g. hole or slot), and the slide has a slide protrusion (e.g. flange or spigot) of complementary configuration or profile to the slide opening such that the slide protrusion can be close-fittingly received in the slide opening, thereby to securely attach the cocking slide to the slide. Advantageously, the cocking slide is configured such that, when the slide is in the open position, the cocking slide overlies the rear end (or a region adjacent to the rear end) of the receiver. That is, the rear or proximal end of the cocking slide advantageously does not extend past or project from the extreme distal end of the receiver when the slide is in the open position.

In some embodiments, the firearm includes a magazine for holding one or more cartridges. In some embodiments, the magazine is configured to hold a plurality of cartridges in a stack. In some embodiments, the cartridges are stacked in a linear upright sequential array (i.e. one on top of the other). In some embodiments, the magazine has generally hollow body, a base and a cartridge opening through which each cartridge can pass to be received within the body of the magazine or removed from the body of the magazine. In some embodiments, the magazine has a biasing means for biasing the or each cartridge within the body of the magazine towards the cartridge opening of the magazine. In some embodiments, the biasing means includes a single biasing element or a plurality of interconnected biasing elements (e.g. coil springs, etc). Preferably, the biasing means is configured to act on the lowermost cartridge with the body of the magazine, thereby to bias the or each cartridge towards the cartridge opening of the magazine. Preferably, the magazine is releasably receivable in the firearm, particularly a receiving formation formed in the receiver of the firearm. In some embodiments, the receiving formation is formed in a grip of the receiver.

In some embodiments, a feeder is provided for carrying and feeding the cartridges to the firearm. In some embodiments, the feeder is a belt feeder. Preferably, the feeder is releasably attachable to the firearm such that the cartridges can be loaded sequentially into the barrel or firing chamber.

According to another aspect of the present invention there is provided a firearm, including:

- a receiver;
- a barrel mountable to the receiver;
- a slide mountable to the receiver, the slide being movable between a cocking position and a firing position; and
- a locking element operatively associated with the barrel, the locking element being displaceable between an inactive position and an active position such that, when the locking element is in the active position, the locking element engages the slide such that movement of the slide towards the cocking position is inhibited.

According to another aspect of the present invention there is provided a firearm, including:

a receiver;

a barrel mountable to the receiver;

a slide mounted to the receiver, the slide being movable between a cocking position and a firing position, wherein the slide is biased towards the firing position;

a locking element operatively associated with the barrel, the locking element being displaceable between an inactive position and an active position such that, when the locking element is in the active position, the locking element bears against a portion of the slide such that movement of the slide relative to the receiver is inhibited.

According to another aspect of the present invention there is provided a firearm, including:

a receiver;

a barrel mountable to the receiver;

a slide mounted to the receiver, the slide being movable between a cocking position and a firing position, wherein the slide is biased towards the firing position;

a locking element operatively associated with the barrel, the locking element being displaceable between an unlocked position and a locking position such that, when the locking element is in the locking position, the locking element engages the slide such that movement of the slide towards the cocking position is inhibited.

BRIEF DESCRIPTION OF THE DRAWINGS

Preferred embodiments of the invention will now be described, by way of example only, with reference to the accompanying drawings in which.

PREFERRED EMBODIMENT OF THE INVENTION

Figure 1:
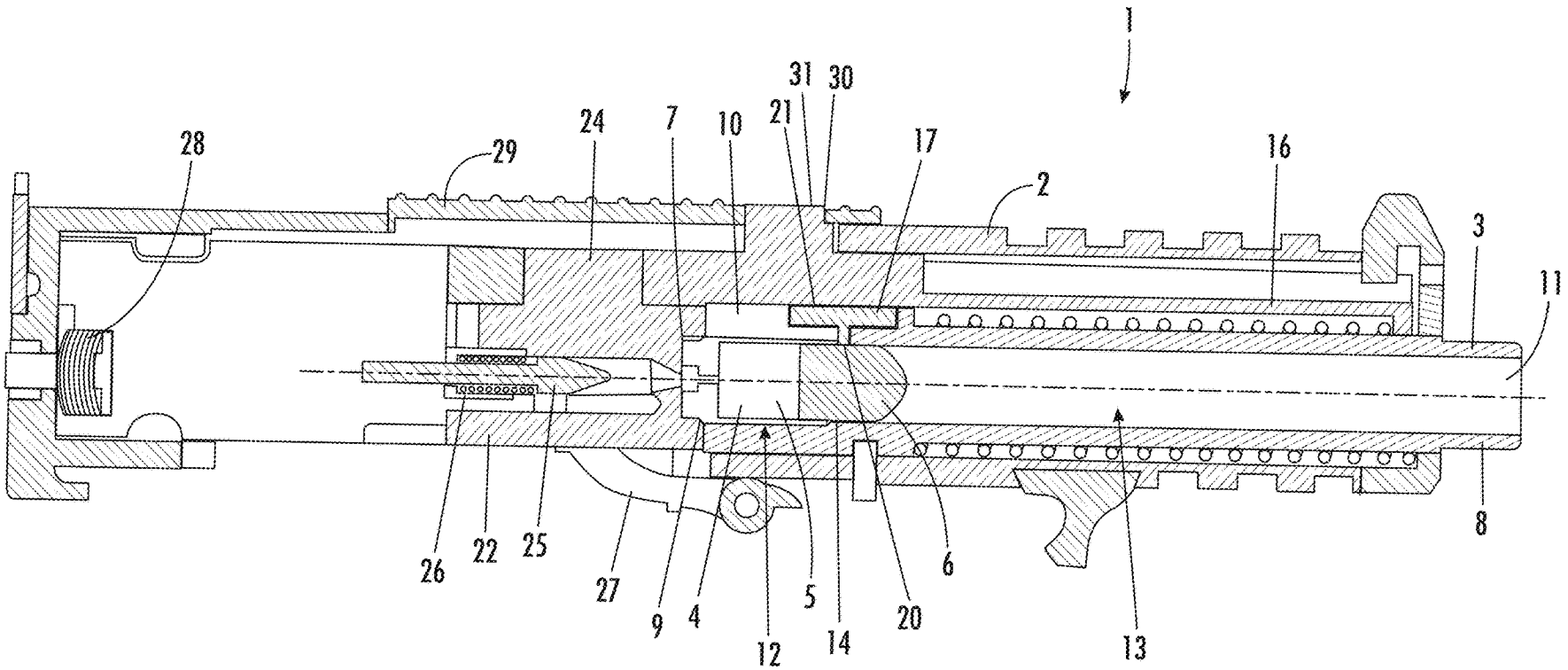
FIG. 1 is a cross-sectional side view of an embodiment of a firearm in a closed position, with a cartridge in a loaded position and the locking element in the inactive position.

The present invention will now be described with reference to the following examples which should be considered in all respects as illustrative and non-restrictive. In the Figures, corresponding features within the same embodiment or common to different embodiments have been given the same reference numerals.

Referring initially to FIG. 1, the invention provides a firearm 1. Preferably, the firearm is a repeating firearm such as a semi-automatic handgun or pistol and will be described predominately in this context. However, the invention is not limited to this particular field of use, and can also be used advantageously in connection with a wide range of firearms and guns including, but not limited to, automatic rifles, sub-machine guns and larger field guns.

The firearm 1 has a receiver 2 and a barrel 3 mountable to the receiver 2.

The firearm 1 is configured to selectively discharge or fire discrete (individual) rounds of ammunition in a sequential manner. Preferably, each discrete (individual) round of ammunition is in the form of a cartridge 4. Each cartridge 4 includes a case 5, a projectile (e.g. bullet) 6, a propellant (e.g. gunpowder or other explodable particulate material or chemical substance) and a primer 7. As most clearly shown in FIGS. 5 to 6, the external diameter of the case 5 is greater than the external diameter of the projectile (bullet) 6. Additionally, the internal diameter of the case 5 is greater than the external diameter of the projectile (bullet) 6, whereby the projectile 6 is at least partially received within the open end of the case 5. That is, there is a certain degree of overlap between the respective ends of the case and projectile. In the illustrated embodiments, each round of ammunition is a centrefire cartridge 4.

The firearm 1 preferably includes a magazine (not shown) for holding one or more cartridges 4 in an ordered manner. The magazine is preferably configured to hold a plurality of cartridges in a stack such as a linear upright sequential array (i.e. one on top of the other). The magazine preferably has generally hollow body, a base and a cartridge opening through which each cartridge can pass to be received within the body of the magazine to load the magazine or removed from the body of the magazine to place a cartridge in a firing chamber or barrel of the firearm. Preferably, the magazine has a biasing means for biasing the or each cartridge within the body of the magazine towards the cartridge opening of the magazine. The biasing means may include a single biasing element or a plurality of interconnected biasing elements (e.g. coil springs, etc). Preferably, the biasing means is configured to act on the lowermost cartridge with the body of the magazine, thereby to bias the or each cartridge towards the cartridge opening of the magazine. The magazine is releasably receivable in the firearm, particularly a receiving formation formed in a grip of the firearm.

The receiver 2 is elongate and includes a proximal (cocking or loading) end and a distal (discharge) end. The receiver 2 has a hollow interior for releasably housing various components of the firearm 1. The hand grip is arranged at or adjacent to the proximal end of the receiver 2 so as to extend transversely (e.g. downwardly) from the receiver. Preferably, the grip is substantially aligned with the longitudinal axis of the receiver. In some embodiments, the grip is integrally formed with the receiver. In some embodiments, the grip is releasably attachable to the receiver.

The barrel 3 is releasably mountable within the hollow interior of the receiver 2. The barrel may be mountable to the receiver such that the barrel is housed entirely within the receiver. In the illustrated embodiments, the barrel 3 is mountable to the receiver 2 such that the barrel 3 is partially housed within the receiver 2. A distal end 8 of the barrel 3 projects outwardly from the distal end of the receiver when the barrel is mounted to the receiver, whereby the distal end or tip of the barrel is spaced from the distal end of the receiver.

The barrel 3 is elongate and has a through passageway or bore extending along the length of the barrel. The barrel 3 has a rear opening 9 formed at the proximal end 10 of the barrel 3 for receiving a cartridge 4 to be discharged by the firearm 1. The barrel 3 has a forward opening 11 formed at the distal end 8 of the barrel 3 to enable the projectile 6 of the cartridge 4 to be discharged from or otherwise exit the barrel 3.

The longitudinal axis of the barrel 3 is aligned with the longitudinal axis of the receiver 2 when the barrel 3 is mounted to the receiver 2. In some embodiments, the cross-sectional profile of the bore or passageway of the barrel 3 varies along the length of the barrel 3. In the illustrated embodiments, the cross-sectional profile of the bore or passageway of the barrel 3 varies along the length of the barrel 3 in a stepwise manner. For example, a first section 12 of the bore has a first diameter, and a second section 13 of the bore has a second diameter, wherein the first and second diameters are different. The inner cross-sectional profile of the bore of the barrel 3 (or each section of the bore of the barrel 3) is circular in shape. As described in further detail below, this change in profile of the bore of the barrel 3 advantageously accounts for the difference in diameter between the case 5 and projectile 6 of the cartridge 4.

The barrel 3 includes a stop 14 for limiting the extent to which the cartridge 4 can be received into (or can travel along) the barrel 3. In the illustrated embodiments, the stop is arranged within the hollow interior of the barrel 3 and is defined by a change to the configuration of the profile of the interior wall of the barrel 3. The stop 14 is arranged at a predetermined distance from the rear opening of the barrel so that, when a cartridge 4 is loaded, a rear surface of the cartridge and thus the primer is held in a predetermined position relative to the rear end of the barrel. In the illustrated embodiments, the rear of the cartridge and primer are positioned so as to project slightly outwardly of the rear end of the barrel 3. Here, the stop 14 is spaced from the rear opening of the barrel 3 by a distance that is less than the length of the case 5 of the cartridge 4.

The barrel 3 has a first portion having a first configuration and a second portion having a second configuration, wherein the stop 14 is defined by the intersection between the first portion and second portion of the barrel 3. The first portion of the barrel 3 has a first diameter, and the second portion of the barrel 3 has a second diameter, wherein the first diameter is greater than the second diameter. The first diameter is equal to or less than the external diameter of the case 5 of the cartridge 4, and greater than the external diameter of the projectile (bullet) 6 of the cartridge, whereby the projectile 6 can freely pass from the first portion of the barrel 3 to the second portion of the barrel 3 whilst the case 5 is prohibited from passing into the second portion of the barrel 3.

Figure 2:
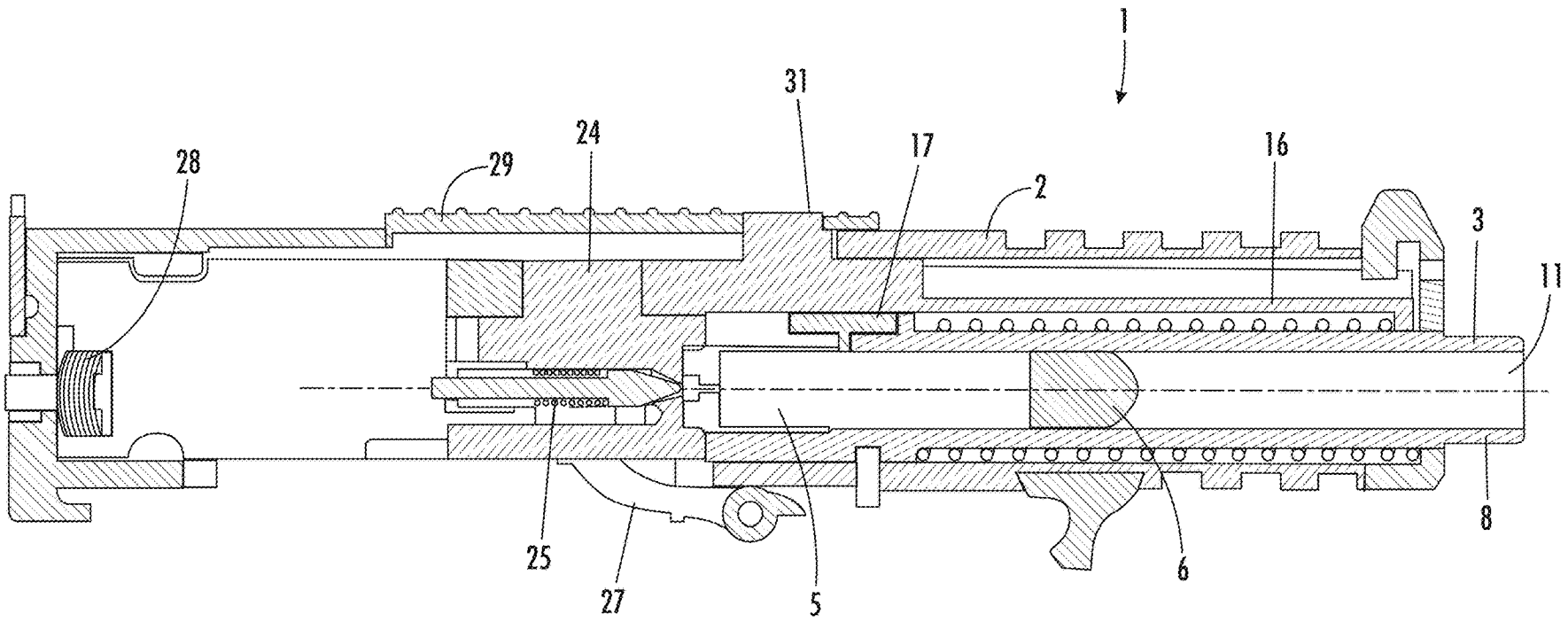
FIG. 2 shows the firearm of FIG. 1 still in a closed position shortly after the cartridge has been discharged, with the locking element in the active position and the projectile partway along the barrel.
Figure 3:
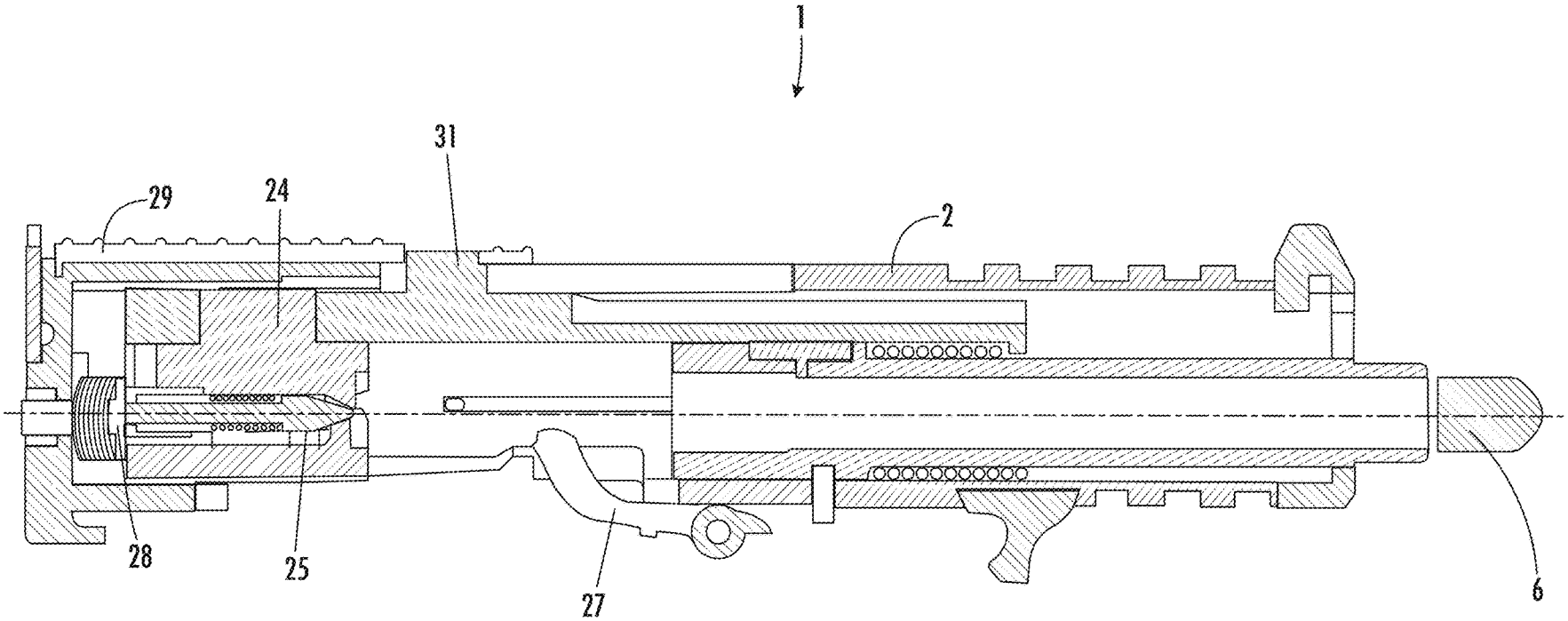
FIG. 3 shows the firearm of FIGS. 1 and 2 in an open position after the projectile has left the barrel, with the locking element returned to the inactive position.

The firearm 1 also includes a slide 16 which is slidably mountable to the receiver 2. The slide 16 is movable between an open position as shown in FIG. 3, and a closed position as shown in FIGS. 1 and 2.

As described in further detail below, the barrel 3 and slide 16 are mounted within the hollow interior of the receiver 2. In this way, the barrel 3 and slide 16 are encapsulated by the receiver 2, thereby to form a pressure vessel or chamber therebetween (i.e. within the hollow interior of the receiver) and such that a pressure ring can advantageously be formed around the barrel 3 and slide 16, in use.

Figure 4:
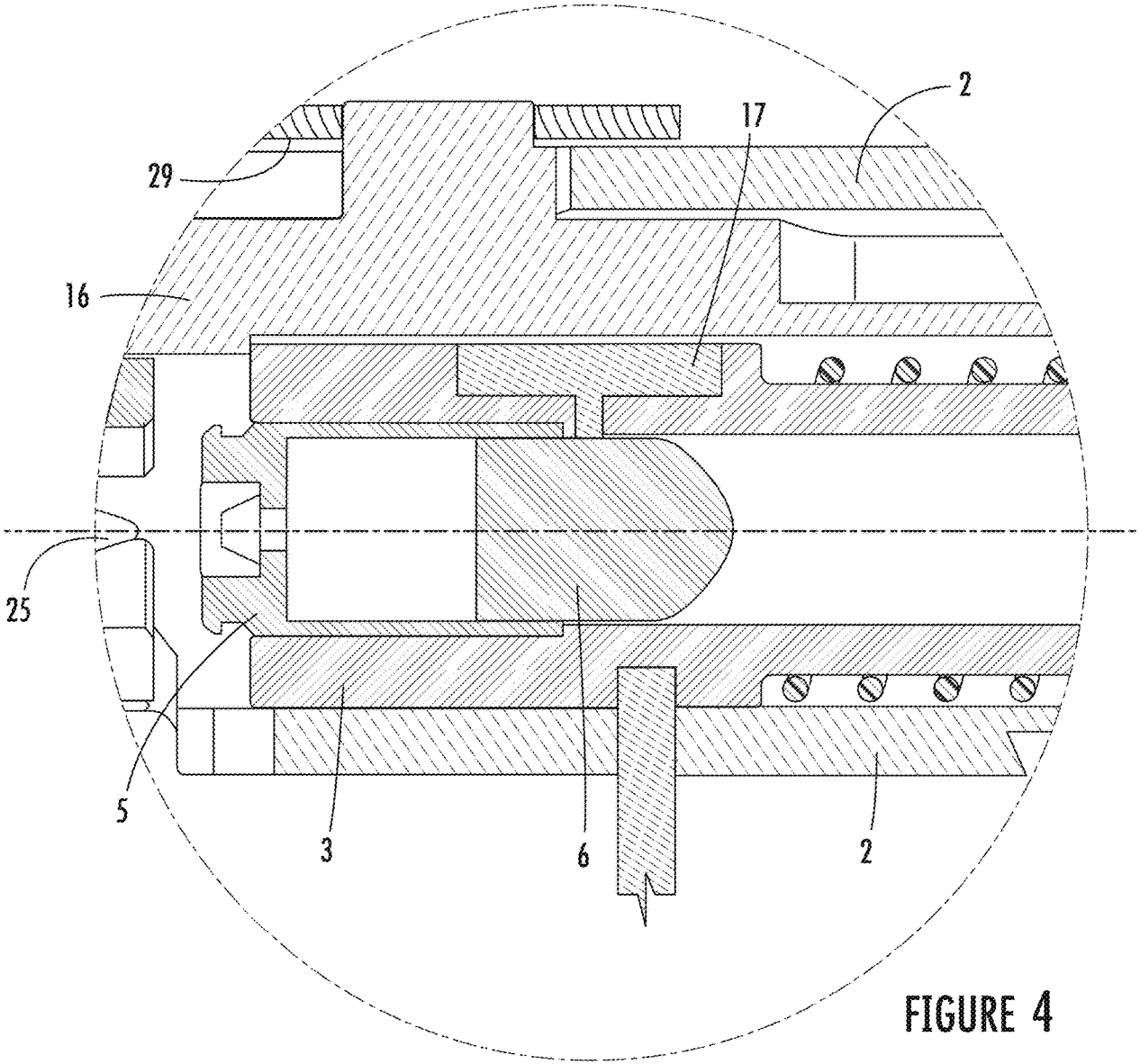
FIG. 4 is an enlarged view of the rear end of the barrel of the firearm of FIG. 1, showing the locking element in the inactive position.
Figure 5:
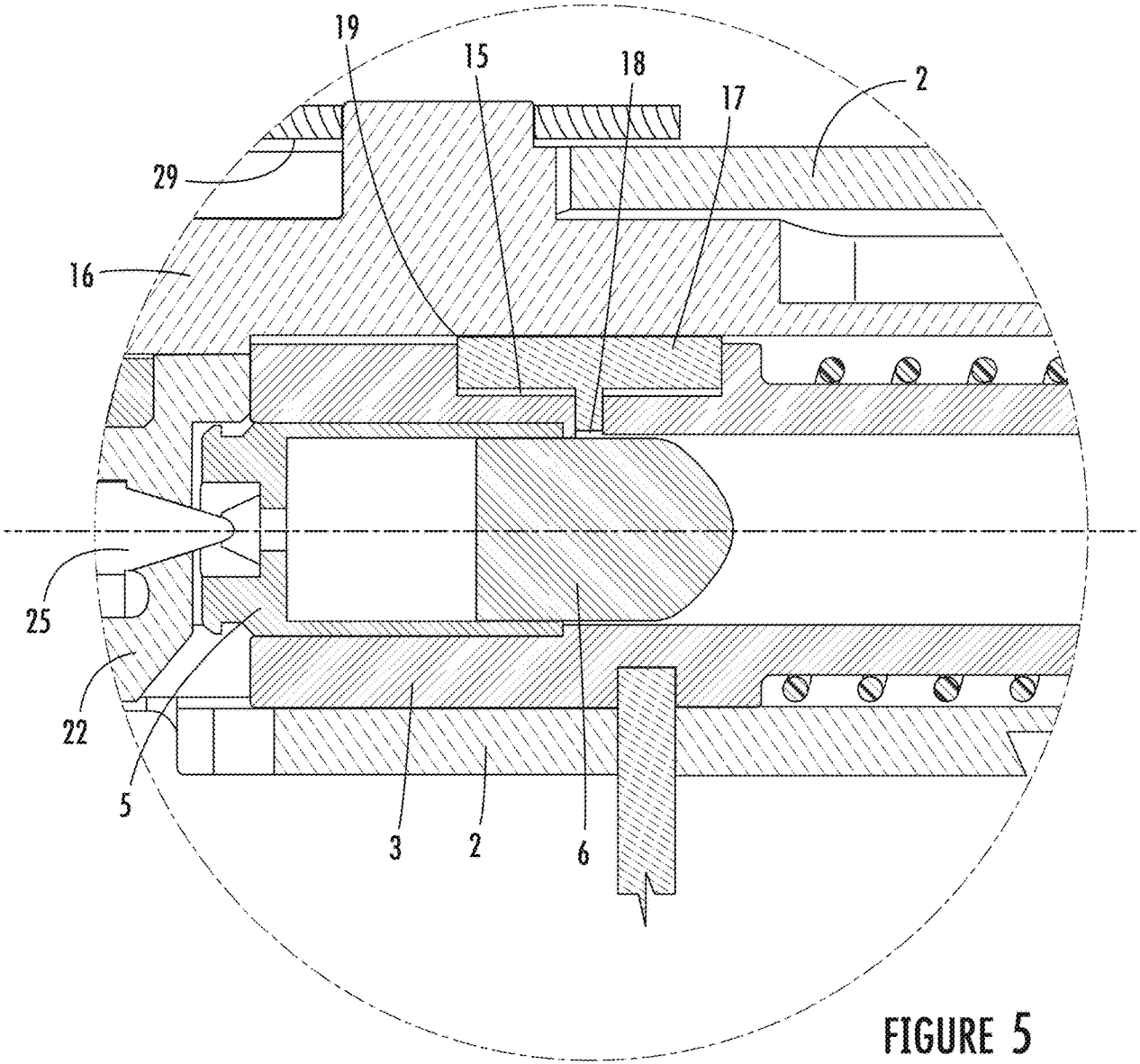
FIG. 5 is an enlarged view of the rear end of the barrel of the firearm, showing the locking element in the active position before the projectile has been removed from the case of the cartridge.
Figure 6:
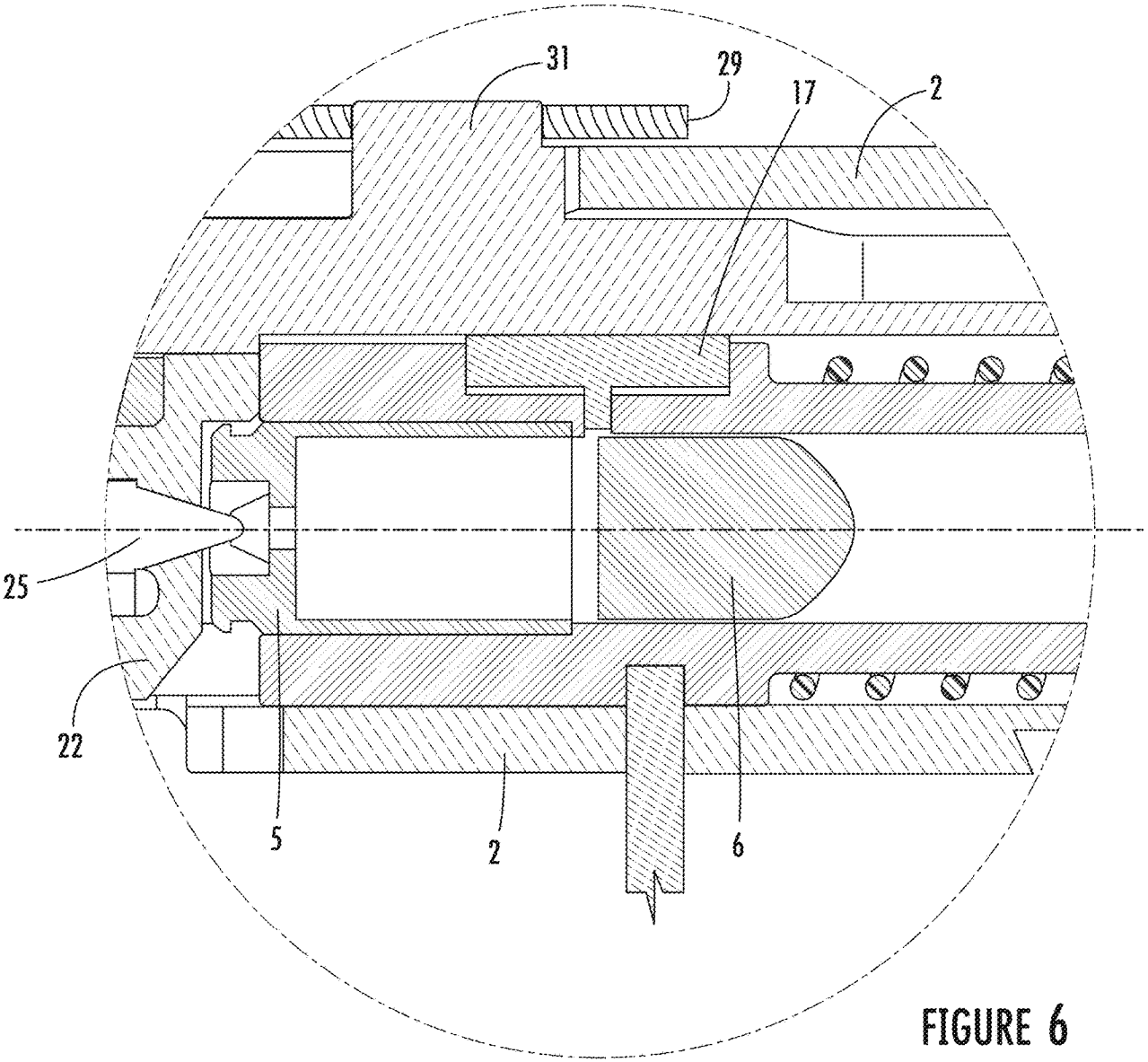
FIG. 6 is an enlarged view of the rear end of the barrel of the firearm, showing the locking element in the active position after the projectile has been removed from the case of the cartridge but is still within the barrel of the firearm.

A locking element in the form of a piston 17 is operatively associated with the barrel 3. The piston 17 is displaceable between an inactive position as shown in FIGS. 1, 3 and 4, and an active position as shown in FIGS. 2, 5 and 6. Advantageously, when the locking element or piston 17 is in the active position, the locking element or piston 17 mechanically and/or frictionally engages the slide 16 such that movement of the slide 16 towards the open position is inhibited. That is, the slide 16 is held or locked in the closed position when the piston 17 is in the active position and engaging the slide 17.

As most clearly shown in FIGS. 4 to 6, the barrel 3 includes a receiving formation 15 for receiving the locking element or piston 17. The receiving formation 15 extends from the inner surface of the barrel to an external surface of the barrel, wherein the receiving formation is in fluid communication with the bore of the barrel. In the illustrated embodiments, the receiving formation 15 is formed in an operatively upper surface of the barrel 3. The receiving formation 15 is generally in the form of a through hole or passageway extending from the inner surface of the bore of the barrel to the external surface of the barrel. Again, in the illustrated embodiments, the receiving formation 15 has a first opening 18 in the inner surface of the bore of the barrel 3, and a second opening 19 in the external surface of the barrel. The open area of the first opening 18 of the receiving formation 15 is less than the open area of the second opening 19 of the receiving formation 15.

A locking element in the form of a piston 17 is operatively associated with the barrel 3. The piston 17 is displaceable between an inactive position as shown in FIGS. 1, 3 and 4, and an active position as shown in FIGS. 2, 5, and 6. Advantageously, when the locking element or piston 17 is in the active position, the locking element or piston 17 mechanically and/or frictionally engages the slide 16 such that movement of the slide 16 towards the open position is inhibited. That is, the slide 16 is held or locked in the closed position when the piston 17 is in the active position and engaging the slide 16.

In the illustrated embodiments, the receiving formation 15 has a stepped profile, including a smaller lower section and a larger upper section (e.g. the lower section has a smaller diameter compared to the diameter of the upper section), thereby to limit the extent to which the piston is received into the receiving formation 15. Here the receiving formation 15 has a generally T-shaped profile when viewed from the side. The locking element or piston 17 is formed as a one-piece unit and similarly has a generally T-shaped profile when viewed from the side.

Figure 8:
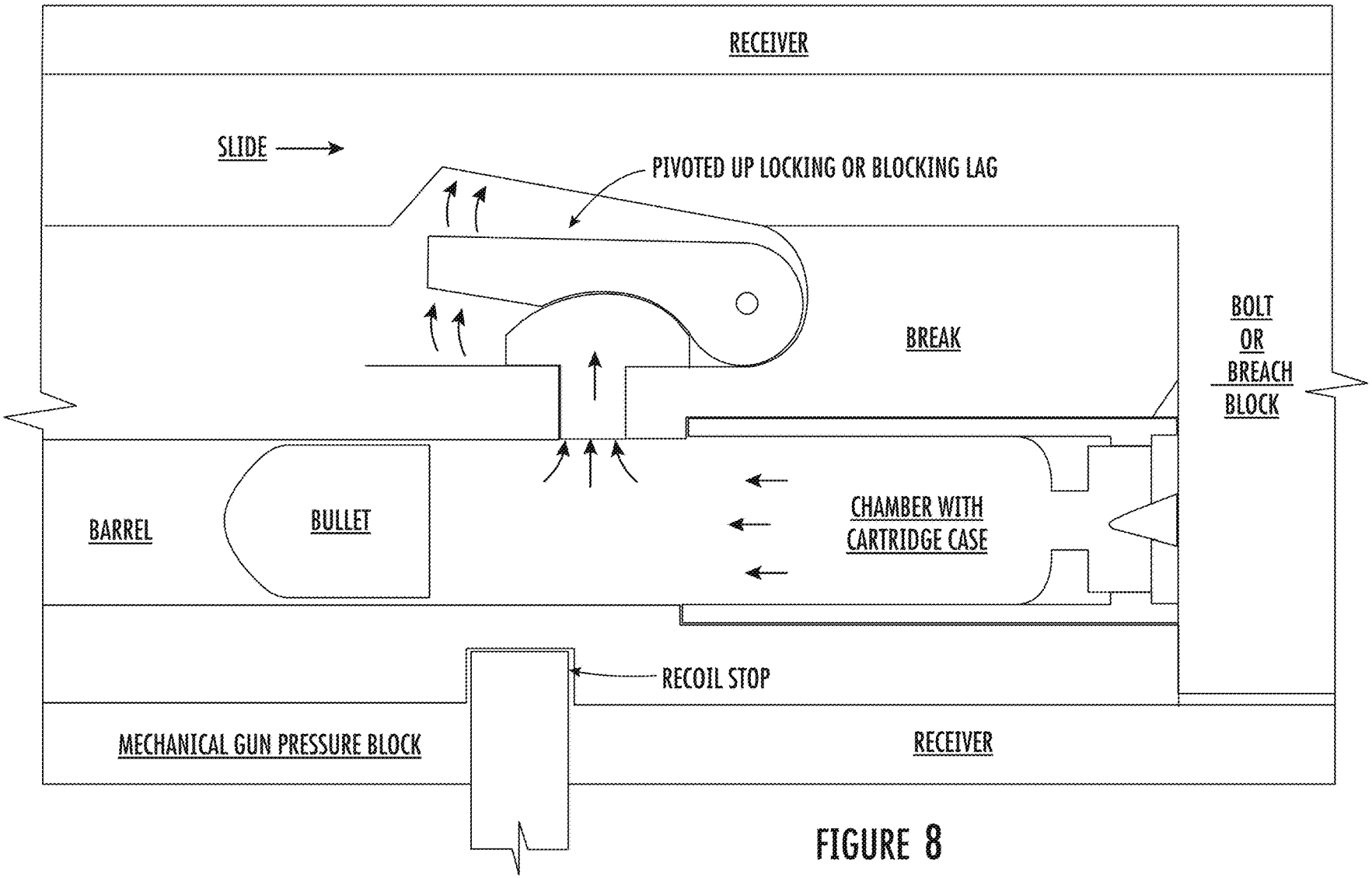
FIG. 8 is an enlarged view of the rear end of the barrel of firearm, showing another embodiment of a locking element which is pivotally mounted to the barrel.

The piston 17 is freely seated, placed, or otherwise positioned in the receiving formation 15 formed in the barrel. Alternatively, the locking element or piston 17 may be anchored at at least one point so as to be pivotally movable between the inactive and active positions as shown in FIG. 8.

The locking element or piston 17 has a lower or activation surface 20, and an upper or engaging surface 21. The locking element or piston 17 is configured such that, when the piston 17 is received in the receiving formation 15 and in its inactive position, the lower surface 20 of the piston 17 is substantially flush with the (internal) surface of the bore of the barrel 3. Similarly, when the locking element or piston 17 is received in the receiving formation 15 and in its inactive position, the upper surface 21 of the piston 17 is substantially flush with the external or outer surface of the barrel.

The locking element or piston 17 is advantageously configured to move between the inactive position and the active position in response to a change in pressure within the bore of the barrel 3, in use. The locking element or piston 17 is configured to move from the inactive position to the active position in response to an increase in pressure within the bore of the barrel 3. The locking element or piston 17 is configured to move from the active position to the inactive position in response to a decrease in pressure within the bore of the barrel. With reference to FIG. 4, the inactive position is an operatively lower position of the locking element or piston 17. With reference to FIGS. 5 and 6, the active position is an operatively upper or raised position of the locking element or piston 17.

The receiving formation 15 formed in the barrel 3, and thus the position of the piston 15, is positioned closer to the proximal end than the distal end of the barrel. More specifically, the receiving formation 15 formed in the barrel is configured such that the piston 15 is aligned with the projectile 6 of the cartridge 4, when the cartridge 4 is positioned in the barrel (e.g. in the first portion or firing chamber of the barrel). The receiving formation is also configured such that the lower or activation surface of the locking element (e.g. piston) is aligned with the projectile of the cartridge when the cartridge is loaded into the barrel. In this way, the receiving formation formed in the barrel is configured such that the locking element is positioned downstream of the stop, or downstream of the first portion of the bore of the barrel.

The locking element or piston 17 is laterally constrained within passageway formed by the receiving formation 15 formed in the barrel 3, whereby the piston 17 moves along a generally vertical axis when the locking element moves from the inactive position to the active positions, and vice versa.

When the piston 17 is arranged within the receiving formation 15, the lower or activation surface 20 of the locking element 17 is unobstructed or otherwise exposed to the bore of the barrel 3, thereby to enable a change in pressure within the bore of the barrel 3 to be registered by the locking element or piston 17 and thus cause the locking element or piston 17 to move between the active and inactive positions in response to a change in pressure within the bore of the barrel 3, in use.

The locking element or piston 17 directly engages the slide 16 when the locking element is in the active or raised position. In the illustrated embodiments, when the locking element is in the active or raised position as shown in FIGS. 5 and 6, the locking element or piston 17 directly engages the slide in secure mating face-to-face contact, thereby to mechanically and/or frictionally hold or lock the slide 16 in the closed position and prevent the slide from moving towards to open position.

The upper or engaging surface 21 of the locking element or piston 17 may be a planar or flat surface. In some embodiments, the upper or engaging surface 21 of the locking element may be configured to have one or more engaging elements to facilitate engagement with the slide. For example the upper or engaging surface 21 of the locking element 17 is provided with one or more friction enhancing elements (not shown). The engaging elements and/or friction enhancing elements may be formed directly in the upper or engaging surface of the locking element. In other embodiments, the engaging elements and/or friction enhancing elements may be separate elements applied, attached, adhered or otherwise fixed to the upper or engaging surface of the locking element.

Figure 7:
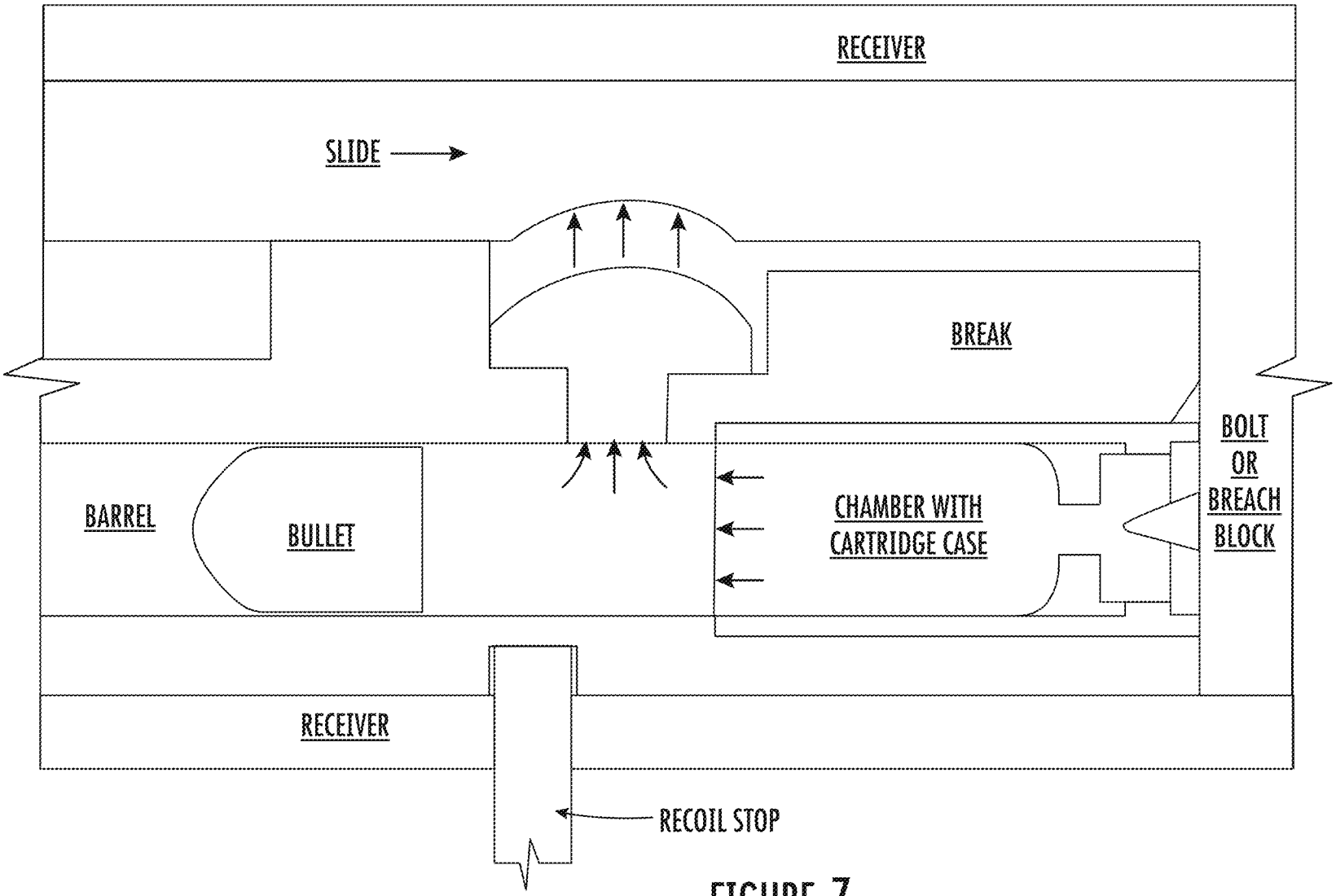
FIG. 7 is an enlarged view of the rear end of the barrel of firearm, showing another embodiment of a locking element having a convex engaging surface.

The locking element 17, preferably the upper or engaging surface 21 of the locking element 17, engages an operatively lower surface of the slide 16. Preferably, the upper or engaging surface 21 of the locking element 17 directly engages an operatively lower surface of the slide 16. With reference to FIGS. 7 and 8, in some embodiments, the slide 16 has an engagable surface or region against which the upper or engaging surface 21 of the locking element 17 bears against when in the active position. Preferably, the engagable surface formed in the slide 16 has a complementary profile to that of the locking element 17, more preferably to the upper or engaging surface of the locking element. The engagable surface is preferably formed in the operatively lower surface of the slide.

For example, the upper or engaging surface 21 of the locking element 17 has a convexly curved profile, and the engagable surface formed in the slide has a complementary inwardly or concavely curved profile, as shown in FIG. 7. In this arrangement, the engagable surface formed in the slide extends inwardly (i.e. away from the operatively lower surface of the slide) such that the upper or engaging surface of the slide is at least partially received in the engagable region when the locking element is in the active position.

Referring to FIGS. 1 to 3, a bolt 22 is attached to the slide 16 such that movement of the slide 16 causes a corresponding movement of the bolt 22, or vice versa. That is, the slide 16 and bolt 22 preferably move in unison. The bolt 22 is attached to an operatively rear end of the slide 16, whereby the bolt 22 effectively closes the rear opening or breech of the barrel 3 when the slide is in the closed position. The slide 16 has a bolt opening (e.g. slot) 23 formed in an operatively upper surface of the slide 16 and towards the rear end of the slide 16, and the bolt 22 has a protrusion (e.g. flange or spigot) 24 of complementary configuration or profile to the bolt opening 23 such that the protrusion 24 can be close-fittingly received in the bolt opening 23, thereby to securely attach the bolt 22 to the slide 16.

As shown in FIGS. 1 and 2, the bolt 22 engages the rear end of the barrel 3 in mating face-to-face contact when the slide 16 is in the closed position.

The bolt 22 houses a firing pin 25. The firing pin 25 is slidably mounted to the bolt 22 such that the firing pin 22 is slidably movable between a first or loaded position (FIG. 1) and a second or firing position (FIG. 2). The firing pin 22 is biased towards the second (firing) position by way of a biasing means in the form of a spring (e.g. coil spring) 26. The spring is arranged within the bolt for biasing the firing pin towards the second (firing) position. Preferably, a sear 27 is operatively associated with the firing pin 25. The sear 27 is movable between a first position in which the sear 27 engages the firing pin 25 to hold the firing pin in the first (loaded) position against the action of the biasing means 26, and a second position in which the firing pin 25 is free to travel towards the second (firing) position under the action of the biasing means 26. That is, the sear 27 preferably does not act on or otherwise interfere with the firing pin 25 when the sear 27 is in its second position.

Referring again to FIGS. 1 to 3, a buffer 28 is arranged within the receiver 2. The buffer 28 is configured to dampen the force associated with movement of the slide 16 and firing pin 25 towards the open position (FIG. 3). The buffer 28 includes a force absorbing element or mechanism in the form of springs, washers or a combination thereof.

A cocking slide 29 is attached to the slide 16 to facilitate cocking of the firearm 1, in use. The cocking slide 29 is slidably mounted externally on the receiver 2. The cocking slide 29 is attached to the slide 16 such that movement of the slide 16 causes a corresponding movement of the cocking slide 29, or vice versa. That is, the slide 16 and cocking slide 29 preferably move in unison. Preferably, an operatively front end of the cocking slide is attached to an operatively rear end of the slide. In the illustrated embodiments, the cocking slide 29 has a slide opening (e.g. hole or slot) 30, and the slide 16 has a slide protrusion (e.g. flange or spigot) 31 of complementary configuration or profile to the slide opening 30 such that the slide protrusion 31 can be close-fittingly received in the slide opening 30, thereby to securely attach the cocking slide 29 to the slide 16. Advantageously, the cocking slide 29 is configured such that, when the slide 16 is in the open position (FIG. 3), the cocking slide 29 overlies the rear end (or a region adjacent to the rear end) of the receiver 2. That is, the rear or proximal end of the cocking slide 29 advantageously does not extend past or project from the extreme distal end of the receiver 2 when the slide is in the open position as shown in FIG. 3.

In use, when a user pulls the trigger (not shown) of the firearm, the sear is moved to release the firing pin. The biasing means then acts on the firing pin to thrust or drive the firing pin towards the cartridge lodged in the firing chamber at the rear of the barrel. The tip of the firing pin strikes and activates the primer which in turn causes the explodable propellant (e.g. gunpowder) housed within the cartridge to explode. The exploded propellant forms a gas which expands to fill the interior of the cartridge. Once the gas has expanded to fill the hollow interior of the cartridge, it is forced through the join formed between the case and the projectile. At this point, the gas that has been released from the interior of the cartridge continues to expand and thereby acts on the lower or activation surface of the locking element (piston) causing the piston to be displaced from (e.g. rise) from the (lower) inactive position. The piston continues to rise until its upper or engaging surface contacts and engages the lower surface of the slide in direct, face-to-face mating contact. The pressure exerted by the expanding gas is advantageously sufficient to force and hold the piston against the slide such that the slide is unable to slide across the upper engaging surface of the piston, and the slide is thereby securely retained in the closed position. This locking of the slide is further and advantageously facilitated by the action of the slide engaging the inner surface of the receiver in response to the piston moving into the active position. The expanding gas continues to act and hold the piston in the active position as the bullet continues to travel along the length of the barrel. Once the projectile or bullet has left the barrel, the expanding gas is free to be discharged from the distal end of the barrel and the pressure within the barrel is immediately decreased. This decrease in pressure within the barrel, causes the piston to return from the active position to the inactive position such that the piston is no longer applying a locking or holding force to the slide, which in turn causes the slide and bolt to actively move backwards to the open position. In other embodiments, the expanding gas will cause the projectile to be removed from the case and start travelling along the barrel before the gas acts on the piston to displace the piston from the inactive to the active position. In either case, the pressure within the barrel is advantageously maintained such that the locking element or piston is actively held in the active position to mechanically and/or frictionally hold the slide in the closed position until the projectile or bullet exits the barrel.

The invention in its various preferred forms provides a number of unique attributes and advantages, including the provision of a relatively simple yet robust, versatile and lightweight gas or pressure operated piston mechanism for mechanically and/or frictionally locking a wide range of repeating, breech loaded firearms. In these and other respects, the invention represents a practical and commercially significant improvement over the prior art.

Although the invention has been described with reference to specific examples, it will be appreciated by those skilled in the art that the invention may be embodied in many other forms. It should also be understood that the various aspects and embodiments of the invention as described can be implemented either independently, or in conjunction with all viable permutations and combinations of other aspects and embodiments. All such permutations and combinations should be regarded as having been herein disclosed.

The invention claimed is:

1. A firearm, including:

a receiver;

a barrel mountable to the receiver;

a slide mountable to the receiver, the slide being movable between an open position and a closed position; and a locking element operatively associated with the barrel, the locking element being displaceable between an inactive position and an active position such that, when the locking element is in the active position, the locking element engages the slide such that movement of the slide towards the open position is inhibited, wherein movement of the locking element from the inactive position to the active position causes a corresponding upward movement of the slide, whereby the slide engages the receiver in secure mating face-to-face contact and thereby to facilitate frictional locking of the slide in the closed position.

2. A firearm according to claim 1, wherein the barrel includes a receiving formation for receiving the locking element, the receiving formation extending from the bore of the barrel to an external surface of the barrel such that the receiving formation is in fluid communication with the bore of the barrel.

3. A firearm according to claim 2, wherein the receiving formation extends in a direction which is generally transverse or orthogonal to a longitudinal axis of the barrel.

4. A firearm according to claim 2, wherein the receiving formation has a first opening associated with an inner surface of the bore of the barrel, and a second opening associated with the external surface of the barrel.

5. A firearm according to claim 4, wherein the open area of the first opening of the receiving formation is different to the open area of the second opening of the receiving formation.

6. A firearm according to claim 4, wherein the open area of the first opening of the receiving formation is less than the open area of the second opening of the receiving formation.

7. A firearm according to claim 2, wherein the receiving formation formed in the barrel is complementary in profile to the locking element.

8. A firearm according to claim 2, wherein the locking element is freely seated within the receiving formation formed in the barrel.

9. A firearm according to claim 1, wherein a longitudinal axis of the locking element extends transversely or orthogonally to the longitudinal axis of the barrel.

10. A firearm according to claim 1, wherein the locking element is arranged for reciprocating linear motion between the inactive position and active position.

11. A firearm according to claim 1, wherein the locking element is movable in a direction which is generally transverse or orthogonal to the longitudinal axis of the barrel.

12. A firearm according to claim 1, wherein the locking element is pivotally movable between the inactive position and the active position.

13. A firearm according to claim 1, wherein the locking element acts as a piston.

14. A firearm according to claim 1, wherein the locking element is configured to move between the inactive position and the active position in response to a change in pressure within the barrel.

15. A firearm according to claim 14, wherein an increase in pressure within the barrel causes the locking element to move from the inactive position to the active position.

16. A firearm according to claim 14, wherein a decrease in pressure within the barrel causes the locking element to move from the active position to the inactive position.

17. A firearm according to claim 1, wherein the inactive position corresponds to an operatively lower position of the locking element, and the active position corresponds to an operatively raised position of the locking element.

18. A firearm according to claim 1, wherein the locking element directly engages the slide when the locking element is in the active position.

19. A firearm according to claim 1, wherein, when the locking element is in the active position, the locking element engages the slide in secure mating face-to-face contact, thereby to frictionally lock the slide in the closed position.

* * * * *